United States Patent [19]

Moulds

[11] Patent Number: 4,874,098

[45] Date of Patent: Oct. 17, 1989

[54] SHIPPING RACK FOR VEHICLE AIR DAMS

[75] Inventor: Julie M. Moulds, Royal Oak, Mich.

[73] Assignee: Chrysler Motors Corporation, Highland Park, Mich.

[21] Appl. No.: 177,214

[22] Filed: Apr. 4, 1988

[51] Int. Cl.[4] ..... A47F 7/00

[52] U.S. Cl. ..... 211/13; 211/41; 206/454

[58] Field of Search ..... 211/13, 41, 195, 175, 211/194, 40, 59.4, 59.2, 43; 108/54.1; 206/454, 451; 293/128

[56] References Cited

U.S. PATENT DOCUMENTS

| | | | |
|---|---|---|---|
| 2,264,264 | 11/1941 | Ferguson | 211/13 |
| 2,443,523 | 6/1948 | Stuart | 211/13 |
| 3,746,176 | 7/1973 | Kotlar | 211/13 |
| 3,913,965 | 10/1975 | Muller et al. | 211/41 X |
| 4,489,835 | 12/1984 | Tombal et al. | 211/41 X |
| 4,629,232 | 12/1986 | Zimlich | 293/128 |
| 4,699,280 | 10/1987 | Hoss | 211/195 |

*Primary Examiner*—Sarah A. Lechok
*Attorney, Agent, or Firm*—Edward A. Craig

[57] ABSTRACT

A shipping rack for vehicle air dams is provided. The air dams are of the type fabricated of a flexible plastic material and have an elongated central portion with relatively short end portions. The shipping rack includes air dam support members which support the end portions of the air dams and have interlocking structure to prevent flopping of the end portions of the air dams when the air dams are loading onto the shipping rack.

5 Claims, 3 Drawing Sheets

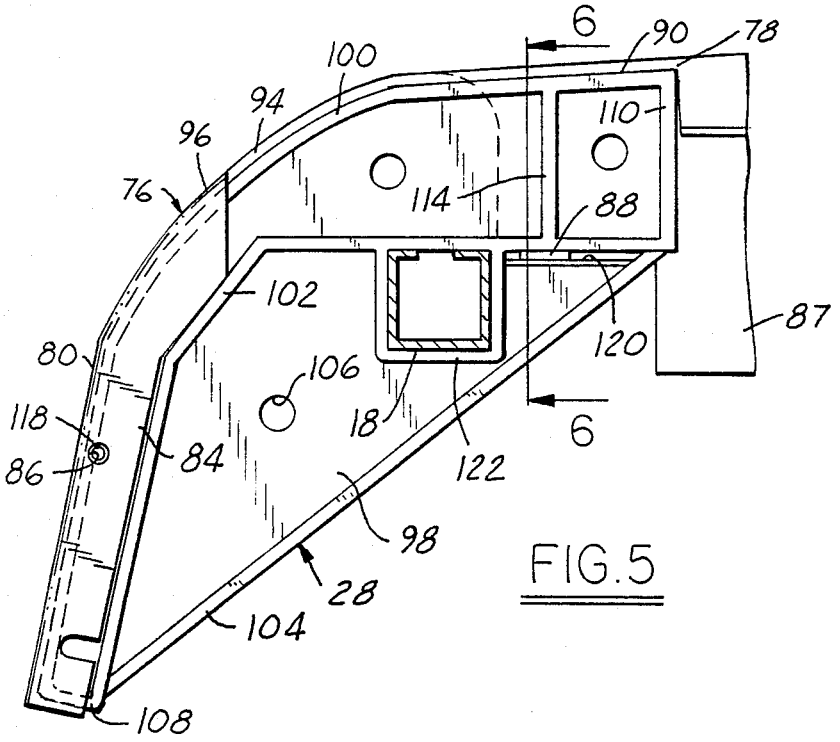
FIG.5
FIG.6
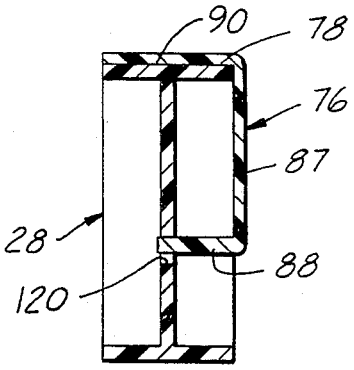
FIG.7
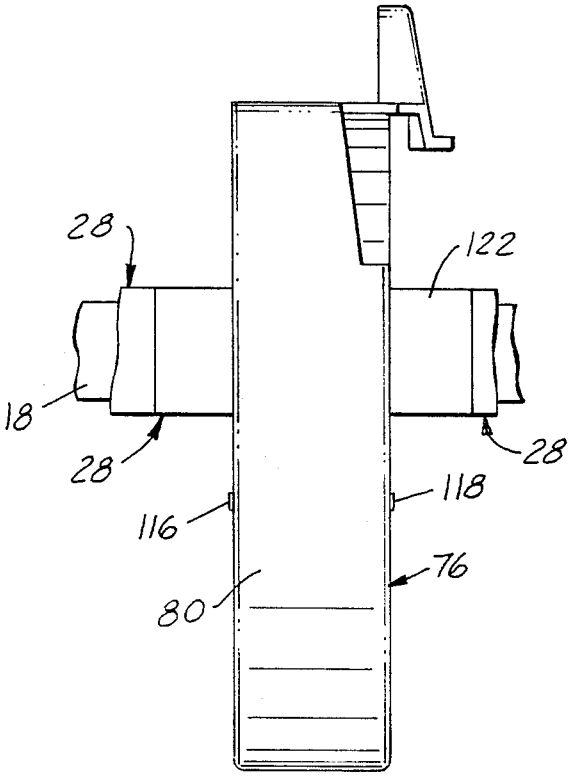

SHIPPING RACK FOR VEHICLE AIR DAMS

BACKGROUND OF THE INVENTION

This application relates to my co-pending application Ser. No. 177,197, filed 04/04/88.

1. Field of the Invention:

This invention relates to a shipping rack for vehicle air dams.

2. Prior Art:

Racks to which the present invention relates are commonly used for shipping industrial parts. The parts are normally elongated members which do not easily fit into box-like containers. The racks used for this purpose normally have a bottom wall and upstanding end walls but not side walls (although the invention is applicable to a rack having side walls). The elements to be shipped can be easaily loaded onto the racks with the racks giving vertical end-wise support. A rack construction of this general character is disclosed U.S. Pat. No. 4,699,280. The present invention is concerned with such a rack which has a vertical air dam support structure particularly suited for the shipment of vehicle air dams which are fabricated of flexible plastic.

Vehicle air dams are frequently used in modern vehicle construction, particularly for cars. The air dams are positioned on the front end of the vehicle beneath the bumper structure. The ari dams serve both a practical function and an ornamental function. Air dams tend to reduce the air pressure beneath the vehicle to thereby cause the vehicle to "hug" the road with consequent improvements in driveability, particularly at higher speeds. From a design point to view, air dams result in the vehicle having an aerodynamic appearance which is desired in modern vehicles, particularly sport type cars.

Air dams are commonly made of flexible plastic material. Use of flexible plastic material is desirable from several points of view, for example, ease of production, ease of assembly, reduction in vehicle weight, and appearance. The flexible nature of the plastic material used to fabricate air dams has caused a problem, however, in connection with vehicles which have wrap-around bumpers. Wrap-around bumpers include a central bumper portion with end portions which extendn around the sides of the vehicle for a short distance. Such a bumper is described in, for example, U.S. Pat. No. 4,629,232. The wrap-around end portions of the vehicle air dam are very prone to flexing when the air dams are shipped. This flexing, if unrestrained, causes distortion or damage to the air dam.

In accordance with the present invention, an air dam support structure is provided on a shipping rack to constrain the end pieces of air dams and prevent unwanted motion thereof during storage and shipment.

SUMMARY OF THE INVENTION

A shipping rack is provided for vehicle air dams. The dams are of the type fabricated of flexible plastic materials. They comprise an elongated central portion for positionment beneath the bumper of a vehicle. Relatively short end portions extend from the central portion. The end portions are adapted to wrap around the sides of the vehicle. Each end portion has a generally horizontally extending wall section with an opening provided therein. The central portion of the air dam has a generally horizontally extending tab at each end thereof. Each of the tabs extends towards the wall section of the adjacent end portion.

The shipping rack includes a bottom wall having a length and a width. An upstanding end wall is provided at each end of the length of the bottom wall. A pair of generally parallel support bars extend between the end walls. At least one air dam support member is carried on each support bar. The air dam support members are oppositely disposed.

The air dam support members each have a generally triangular shape defining a generally horizontal support surface and a generally vertical support surface. A pin extends outwardly from one side of each air dam support member adjacent to the generally vertical support surface. Each air dam support member has a slot therein adjacent to the generally horizontal support surface.

A vehicle air dam is received on and supported by the air dam support members with the ends of the central portion of the air dam supported by the generally horizontal support surfaces and the air dam end portions supported by the generally vertical support surfaces with the pins extending through the openings in the air dam wall section and with the tabs extending into the slots provided in the air dam support members to thereby retain the air dam in place on the air dam support members.

Preferably, a pin is provided on each side of oeach air dam support member and the slot extends entirely through each air dam support member whereby each air dam support member can be used on either side of the shipping rack.

Each air dam support member has a tubular portion extending at substantially right angles to the plane defined by the horizontal and vertical support surfaces. The tubular portion is generally rectangular in cross-section. The support bars have a mating rectangular cross-section. The tubular portions of the air dam support members are slidably received on the support bars and prevented from rotation thereon due to the rectangular cross-section configurations.

Preferably, the air dam support member horizontal and vertical support surfaces are joined together by a curved support surface. A plurality of air dam support members are provided on each support bar in oppositely disposed relationship for receiving a plurality of air dams as aforesaid.

DESCRIPTION OF THE DRAWINGS

FIG. 5 is a sectional view of an air dam support member with an air dam received thereon taken substantially along the line 5—5 of FIG. 1 looking in the direction of the arrows;

FIG. 6 is a sectional view taken substantially along the line 6—6 of FIG. 5 looking in the direction of the arrows; and FIG. 7 is an elevaational view of an air dam support member with an air dam received thereon as viewed from the left side in FIG. 5.

DETAILED DESCRIPTION OF A PREFERRED EMBODIMENT

Figure 1:
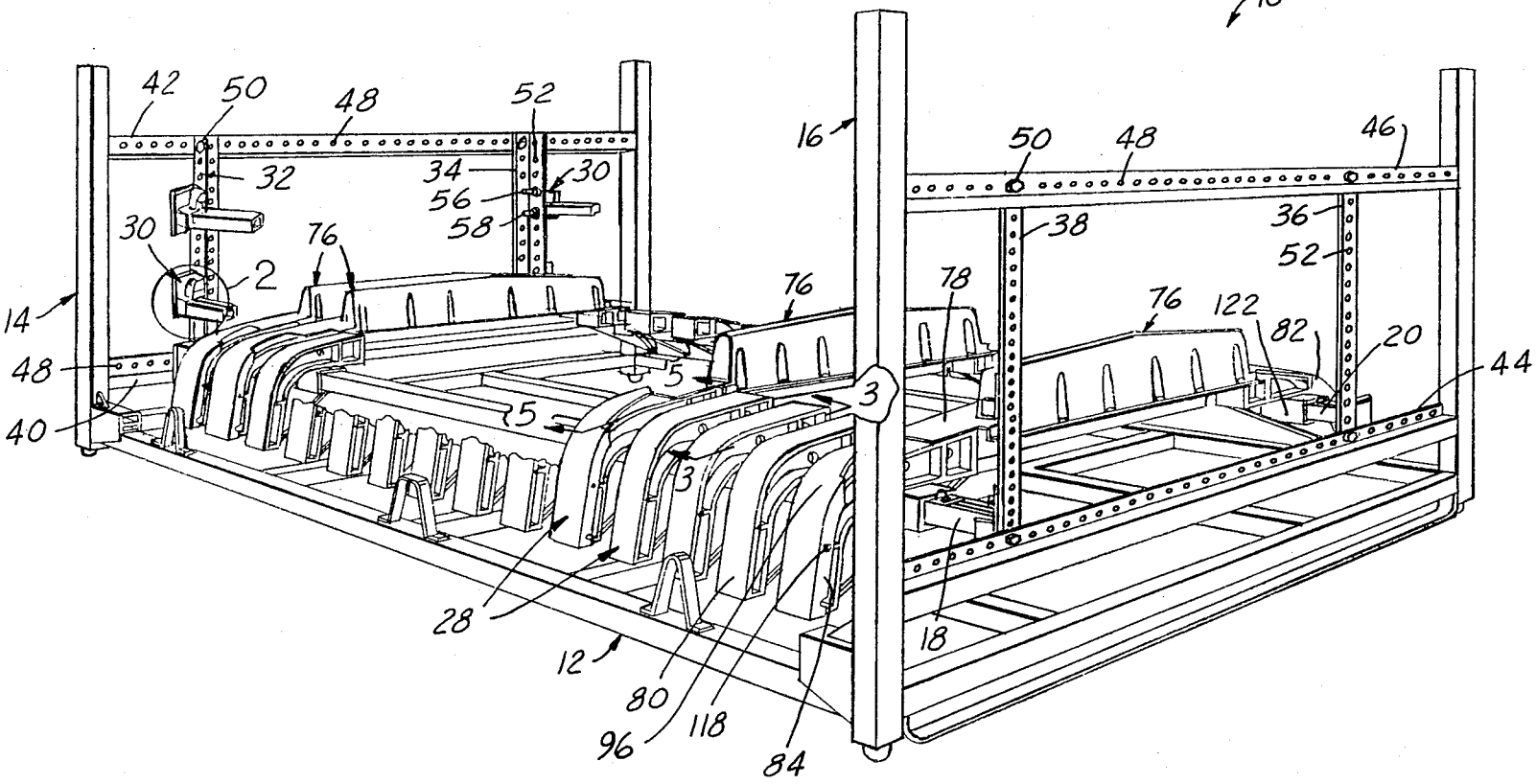
FIG. 1 is a view in perspective of a shipping rack for vehicle air dams forming one embodiment in accordance with the present invention.
Figure 2:
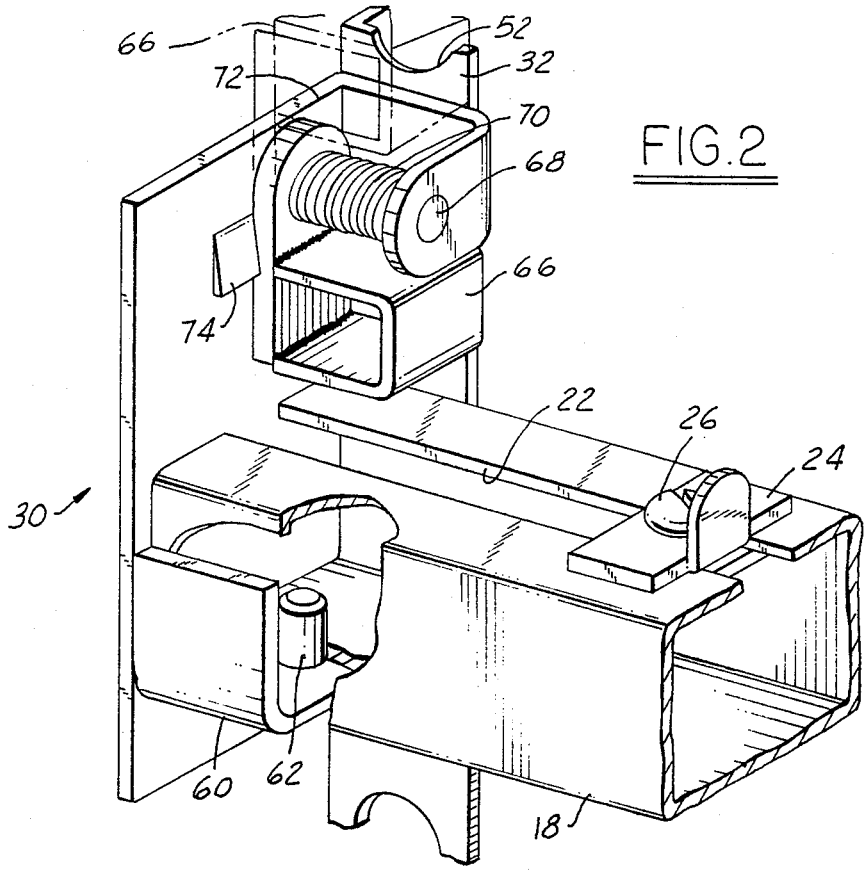
FIG. 2 is a view in perspective of the structure enclosed in the circle labeled 2 in FIG. 1.
Figure 3:
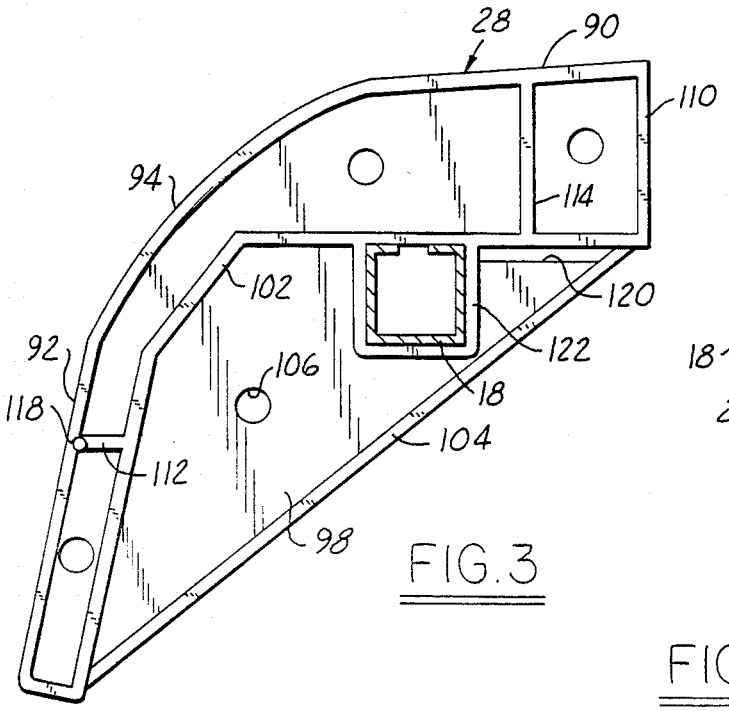
FIG. 3 is a sectional view of an air dam support member taken substantially along the line 3—3 of FIG. 1 looking in the direction of the arrow.
Figure 4:
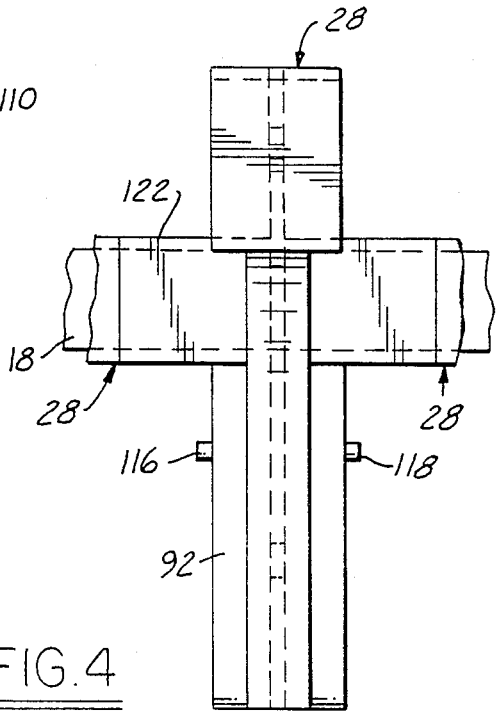
FIG. 4 is an elevational view of the air dam support member of FIG. 3 as seen from the left side.

Referring to FIG. 1, it will be noted that the shipping rack for vehicle air dams 10 includes a bottom wall 12 having a length and a width. An upstanding end wall 14, 16, is provided at each end of the length of the bottom wall 12. A pair of generally parallel support bars 18, 20 extend between the end walls 14, 16. The support baras 18, 20 are tubular in construction and have a generally rectangular cross-section. As will be noted in FIG. 2, a longitudinal slot 22 is provided in the upper wall of each support bar. The function of the slot 22 is to receive a locking member 24 which may be fixed in one position by means of a screw 26 to retain the air dam support members 28 in place.

As shown in FIGS. 1 nd 2, the support bars 18, 20 are retained in place by means of support and latlching structure 30 provided on end wall uprights 32, 34, 36, 38. As will be noted, each end wall has a pair of horizontally extending cross bars 40, 42, 44, 46. Each cross bar has a plurality of openings 48 for attachment of the uprights at different positions by means of bolts 50. The uprights are angle members and have openings 52 provided on one wall. The openings 52 receive threaded studs 56, 58 of the structure 30 for securement of this structure by means of nuts at the desired vertical level. Each structure 30 includes a U-shaped channel portion 60 having an upstanding pin 62. The pin 62 is received in an opening provided in the end of each support bar to thereby retain the support bars in place. Further restraint for the support bars is provided by mens of a spring-loaded latch 66. As will be noted, the latch 66 is pivotly mounted on a pivot pin 68 which also carries a coil spring 70. The spring 70 urges the member 66 towards wall 72. A stop element 74 normally prevents pivoting of the member 66, causing the member 66 to be positioned to impede upward movement of the support bar. However, the member 66 may be manually forced away from the wall 72 so that it will pass over stop 74 into the dotted position shown. In this position, it does not block the support bar and thereby permits removal or mounting of a support bar.

As will be appreciated from the above described structure, the endn wall uprights 32, 34, 36, 38 may be moved transversely as desired and the end wall support and latching structures 30 may be moved vertically as desired to thereby accommodate loading of vehicle air dams of different sizes. As will be noted in FIG. 1, several layers of vehicle air dams may be loaded onto the shipping rack 10, three levels being indicated.

The vehicle air dams 76 are fabricated of a flexible plastic material such as polyethylene. Each air dam comprises an elongated central portion 78 which is ultimately positioned beneath the bumper of a vehicle, normally on the front of the vehicle. Relatively short end portions 80, 82 extend from the central portions. The end portions are adapted to wrap around the sides of a vehicle. Each end portion has (when positioned on the rack 10) a generally vertically extending wall section 84 with an opening 86 provided therein. The central portion 78 has (when positioned on the rack) a generally vertically extending wall 87 having a horizontally extending tab 88 at each end thereof. Each of the tabs 88 extends towards the wall section 84 of the adjacent end portion of the air dam. The opening 86 and tab 88 are ultimately used in mounting of the vehicle air dam 76 onto an air dam support member 28.

As will be noted, a plurality of air dam support members 28 are carried on each support bar 18, 20. The air dam support members on one support bar 18 are oppositely disposed from a counterpart air dam support member on the other support bar 20, with each pair of air dam support members supporting air air dam 76.

The air dam support members 28 have a generally triangular shape and define a generally horizontal support surface 90 and a generally vertical support surface 92. These support surfaces are interconnected by a curved support surface 94. The curved support service 94 is adapted to support the curved portion 96 of the air dam 76. The air dam support members comprise a central wall 98 having a peripheral spaced apart rib structure 100, 102 thereon. The rib structure 100 defines the support surfaces above referred to. An additional rib 104 is provided along the opposite edge of the wall 98 to thereby provide a structurally sound member. The air dam support member is fabricated of a tough structural foam plastic. Several openings 106 are provided in the wall 98 to lighten the structure to reduce its shipping weight. Walls 108, 110 extend between the ends of the rib structures 100, 102 and additional walls 112, 114 are provided intermediate thereof for structural rigidity.

A pin 116, 118 extends outwardly from each side of the outer rib 100 adjcent to the vertical support surface 92 and intermediate the ends thereof. An elongated slot 120 is provided in the wall 98 and extends entirely therethrough. The slot 120 is positioned adjacent to the rib 102 so as to be adjacent to the horizontal support surface 90.

A tubular portion 122 is provided on the wall 98. The tubular portion 122 extends at substantially right angles to the plane defined by the horizontal and vertical support surfaces 90, 92, considering these surfaces to be the equivalent of a line function. The tubular portion 122 is generally rectangular in cross-section and mates with the shape of the support bars 18, 20. The tubular portions 122 of the air dam support members 28 are slidably received on the support bars 18, 20. The air dam support members 28 are prevented from rotating on the support bars 18, 20 due to the rectangular cross-sectional configurations above referred to.

Vehicle air dams 76 are receivable on and supported by each pair of oppositely disposed air dam support members with the outer ends of the central portion 78 of each air dam being supported by the generally horizontal support surfaces 90 of the air dam support members and with the air dam end portions 80, 82 supported by the generally vertical support surfaces 92 of the air dam support members 28. One of the pins 116, 118 of each oppositely disposed air dam support member 28 extendds through the opening 86 in the well section 84 of each air dam. The tabs 88 of the air dams extend into the slot 120 provided in the air dam support members 28 to thereby retain the air dams 76 in place on the support members 28. This prevents the end portions 80, 82 of the air dams from flopping or twisting during shipment which may occur because of the flexible nature thereof. This could cause damage to the air dams if not prevented.

I claim:

1. A shipping rack for vehicle air dams, the dams being of the type fabricated of flexible plastic material and comprising an elongated central portion for positionment beneath the bumper of a vehicle, relatively short end portions extending from the central portion, the end portions adapted to wrap around the sides of a vehicle, each end portion having, when positioned on the rack, a generally verically extending wall section with an opening provided therein, the central portion having, when positioned on the rack, a generally horizontally extending tab at each end thereof, each of said tabs extending towards the wall section of the adjacent end portion, the shipping rack including a bottom wall having a length and a width, an upstanding end wall at each end of the length of the bottom wall, a pair of generally parallel support bars extending between said end walls, at least one air dam support member carried on each support bar, said air dam support members being oppositely disposed, the support members each having a generally triangular shape defining a generally horizontal support surface and a generally vertical support surface, a pin extending outwardly from one side of each air dam support member adjacent to the generally vertical support surface, each air dam support member having a slot therein adjacent to the generally horizontal support surface, a vehicle air dam received on and supported by said air dam support member with the outer ends of the central portion of the air dam supported by said surfaces and the air dam end portions supported by said generally vertical support surfaces with said pins extending through the openings in said wall sections and with said tabs extending into the slots provided in the air dam support member to thereby retain the air dam in place on the air dam support members.

2. A shipping rack is defined in claim 1, further characterized in that a pin is provided on each side of each air dam support member and said slot extenddsd entirely through each air dam support member whereby each air dam support member can be used on either side of the shipping rack.

3. A shipping rack is defined in claim 1, further characterized in that each air dam support member has a tubular portion extending at substantially right angles to the plane defined thereof by said horizozntal and verticl support surfaces, said tubular portion being generally rectangular in cross-section, said support bars having a mating rectangular cross-section, said tubular portions of the air dam support members being slidably received within said support bars said rectangular cross-sectional configurations of said slidably received tubular portions and support bars preventing relative rotation thereof.

4. A shipping rack is defined in claim 1, further characterized in that said air dam support member horizontal and vertical support surfaces are joined together by a curved support surface.

5. A shipping rack is defined in claim 1, further characterized in that a plurality of oppositely disposed pairs of air dam support members are provided on the support bars to receive a plurality of air dams.

* * * * *